US005112041A

United States Patent [19]

Honegger

[11] Patent Number: 5,112,041

[45] Date of Patent: May 12, 1992

[54] PROCESS AND APPARATUS FOR TRANSPORTING PRINTING PRODUCTS ARRIVING IN IMBRICATED FORMATION

[75] Inventor: Werner Honegger, Tann Rüti, Switzerland

[73] Assignee: Ferag AG, Hinwil, Switzerland

[21] Appl. No.: 579,537

[22] Filed: Sep. 10, 1990

[30] Foreign Application Priority Data

Sep. 13, 1989 [CH] Switzerland ..... 3339/89

[51] Int. Cl.[5] ..... B65H 29/60

[52] U.S. Cl. ..... 271/286; 271/184; 271/199; 271/303; 198/457

[58] Field of Search ..... 198/457; 271/184, 185, 271/225, 279, 280, 285, 286, 296, 300, 302, 303, 199

[56] References Cited

U.S. PATENT DOCUMENTS

| | | | |
|---|---|---|---|
| 2,754,953 | 7/1956 | Groncy | 198/457 |
| 3,044,772 | 7/1962 | Trenner . | |
| 3,239,676 | 3/1966 | Pali . | |
| 3,430,784 | 3/1969 | Hall | 271/300 |
| 3,977,537 | 8/1976 | Buccicone | 271/300 |
| 4,201,377 | 5/1980 | Honegger | 271/225 |
| 4,311,230 | 1/1982 | Crawford | 198/457 |
| 4,456,242 | 6/1984 | Morin | 271/225 |
| 4,538,161 | 8/1985 | Reist . | |
| 4,566,582 | 1/1986 | Linder | 271/302 |
| 4,572,350 | 2/1986 | Besemann | 198/457 |
| 4,953,843 | 9/1990 | Reist . | |
| 4,986,730 | 1/1991 | Wetter | 198/457 |

FOREIGN PATENT DOCUMENTS

| | | | |
|---|---|---|---|
| 0038918 | 11/1981 | European Pat. Off. . | |
| 0326518 | 1/1989 | European Pat. Off. . | |
| 295382 | 7/1915 | Fed. Rep. of Germany | 198/457 |
| 590480 | 1/1934 | Fed. Rep. of Germany . | |
| 2027422 | 11/1974 | Fed. Rep. of Germany . | |
| 2820957 | 12/1978 | Fed. Rep. of Germany . | |
| 566925 | 9/1975 | Switzerland . | |
| 484093 | 12/1975 | U.S.S.R. | 271/225 |

*Primary Examiner*—Robert P. Olszewski
*Assistant Examiner*—Steven M. Reiss
*Attorney, Agent, or Firm*—Oliff & Berridge

[57] ABSTRACT

A belt conveyor (10) leads past two branch-off points (12,12') arranged behind one another, viewed in a conveying direction (F). Removal conveyors (14, 14'), whose conveying-away direction (W) runs at an angle to the conveying direction (F), lead away from the branch-off points (12, 12'). The printing products (18) are arranged on the belt conveyor (10) in an imbricated formation (S) in which each printing product (18) lies on the preceding one. In addition, the edges (20 and 26) of the printing products (18) run at an angle to the conveying direction (F), the leading folded edges (20) being oriented perpendicular to the conveying-away direction (W). The printing products (18) fed to the branch-off point (12, 12') may be selectively conveyed past the relevant branch-off point (12, 12') without any change in their position with respect to the conveying direction (F) or deflected in a branch-off direction (A). The deflected printing products (19) are supplied to the removal conveyor (14, 14') in an imbricated formation (S') in which the leading folded edges (20), viewed in the conveying-away direction (W), run at right angles to the conveying-away direction (W) and the side edges (22, 24) are aligned with one another.

20 Claims, 4 Drawing Sheets

PROCESS AND APPARATUS FOR TRANSPORTING PRINTING PRODUCTS ARRIVING IN IMBRICATED FORMATION

BACKGROUND OF THE INVENTION

1. Field of the Invention

The present invention relates to a process and an apparatus for transporting printing products, in particular multi-sheet and folded printing products.

2. Description of the Related Art

An apparatus for transporting folded printed sheets arriving in an imbricated formation is disclosed in German Offenlegungsschrift 3,335,140 and the corresponding U.S. Pat. No. 4,566,582. This apparatus is provided with a belt conveyor leading past a branch-off point, and a removal conveyor, with a conveying-away direction parallel to the conveying direction, following the branch-off point downstream, viewed in the conveying direction of the belt conveyor, and arranged next to and in the same plane as the belt conveyor. A branching-off device is provided at the branch-off point in order to supply to the removal conveyor a part of the imbricated formation fed by the belt conveyor. The other part of the imbricated formation is guided unchanged past the branch-off point by means of the belt conveyor. In the fed imbricated formation, each printed sheet lies on the preceding one, viewed in the conveying direction, the leading edges of the printed sheets run at right angles to the conveying direction and the side edges are aligned with one another. The branching-off device has two rolls, arranged at the free end of an arm which can swivel about a vertical axis, driven in rotation and defining a conveying nip active in the diagonal direction of the fed printed sheets, the components, running parallel to the conveying direction of the belt conveyor, of the circumferential speed of these rolls being at least equal to the conveying speed of the belt conveyor. A shaft is, furthermore, swivelably mounted on the arm and carries at its free end a flap which precedes the lower roll upstream, viewed in the conveying direction. In order to branch off printed sheets from the fed imbricated formation, the arm is swiveled and lowered relative to the belt conveyor such that the tongue slips between two printed sheets of the imbricated formation lying on top of one another and feeds the printed sheet which comes to lie on the tongue, and the printed sheets following this printed sheet, viewed in conveying direction, to the conveying nip defined by the rolls. In order to retain the position of the printed sheets with respect to the conveying direction of the belt conveyor, the rolls act upon the printed sheets in a straight line which passes through the center of gravity of the printed sheets. In order to enable the printed sheets to be taken up by the rolls of the branching-off device, the fed imbricated formation is arranged on the belt conveyor offset laterally toward the branching-off device such that a relatively broad lateral edge region of the imbricated formation projects from the belt conveyor. The printed sheets taken up by the branching-off device are pushed on top of one another onto the removal conveyor in order to form a new imbricated formation which corresponds exactly to the fed imbricated formation. As soon as a sufficient number of printed sheets has been detached from the fed imbricated formation, the arm of the belt conveyor is swiveled away out of the edge region of the fed imbricated formation, carrying with it the last printed sheet fed to the conveying nip.

Various measures must be taken in this known apparatus in order to allow the printed sheets which are to be supplied to the removal conveyor to be taken up. The imbricated formation must thus be arranged laterally offset on the belt conveyor. Moreover, the branching-off device has a complex design and must be designed such that it is able to be raised and lowered, be swiveled about the vertical axis and be displaced in a direction at right angles to the conveying direction.

SUMMARY OF THE INVENTION

The object of the present invention is therefore to further develop a known process and to provide an apparatus of the generic type in which and by means of which, respectively, printing products of the fed imbricated formation, which are to be led in a direction at an angle to the conveying direction, can be acted upon in a trouble-free and simple way.

This object is achieved by conveying the printing products in an imbricated formation to a branch-off point, a number of the printing products essentially retaining their position with respect to the feed direction and being conveyed past the branch-off point, and the remainder of the printing products being led at the branch-off point in a branch-off direction running at an angle to the feed direction wherein the printing products are fed with edges thereof inclined at an angle with respect to the feed direction and overlapping one another. By virtue of the printing products being fed to the branch-off point with edges running at an angle with respect to the feed direction, and overlapping one another, and being partially conveyed past this branch-off point, it is astonishingly simple to act upon the printing products to be led in a branch-off direction. As a result of the incline of the fed printing products, an edge region is exposed which is not covered or underlaid by any other printing product so that the printing products are present in this edge region quasi-individually.

In an especially preferred embodiment of the process according to the invention, the printing products are led in a branch-off direction which corresponds approximately to the incline of the fed printing products. The edges of the branched-off printing products thus run essentially parallel and perpendicular to the branch-off direction, respectively, which enables these printing products to be branched-off and guided in the region of the branch-off point in an especially simple manner. If printing products are detached from the fed imbricated formation sectionwise while retaining their position with respect to the feed direction, then, when led on in the branch-off direction, they form an imbricated formation with leading edges running essentially at right angles to the branch-off direction and side edges aligned with one another, which is advantageous for certain further processing operations.

If the printing products led in the branch-off direction are fed to a removal conveyor, then, by aligning the conveying-away direction of this removal conveyor appropriately, an imbricated formation can be formed in which the side edges of the printing products can assume virtually any desired angle with respect to the conveying-away direction.

Preferred embodiments of the process according to the invention and preferred embodiments of the apparatus according to the invention are also provided.

BRIEF DESCRIPTION OF THE DRAWINGS

The invention will now be described in more detail with reference to an exemplary embodiment shown in the drawings, in which purely schematically.

DETAILED DESCRIPTION OF PREFERRED EMBODIMENTS

Figure 1:
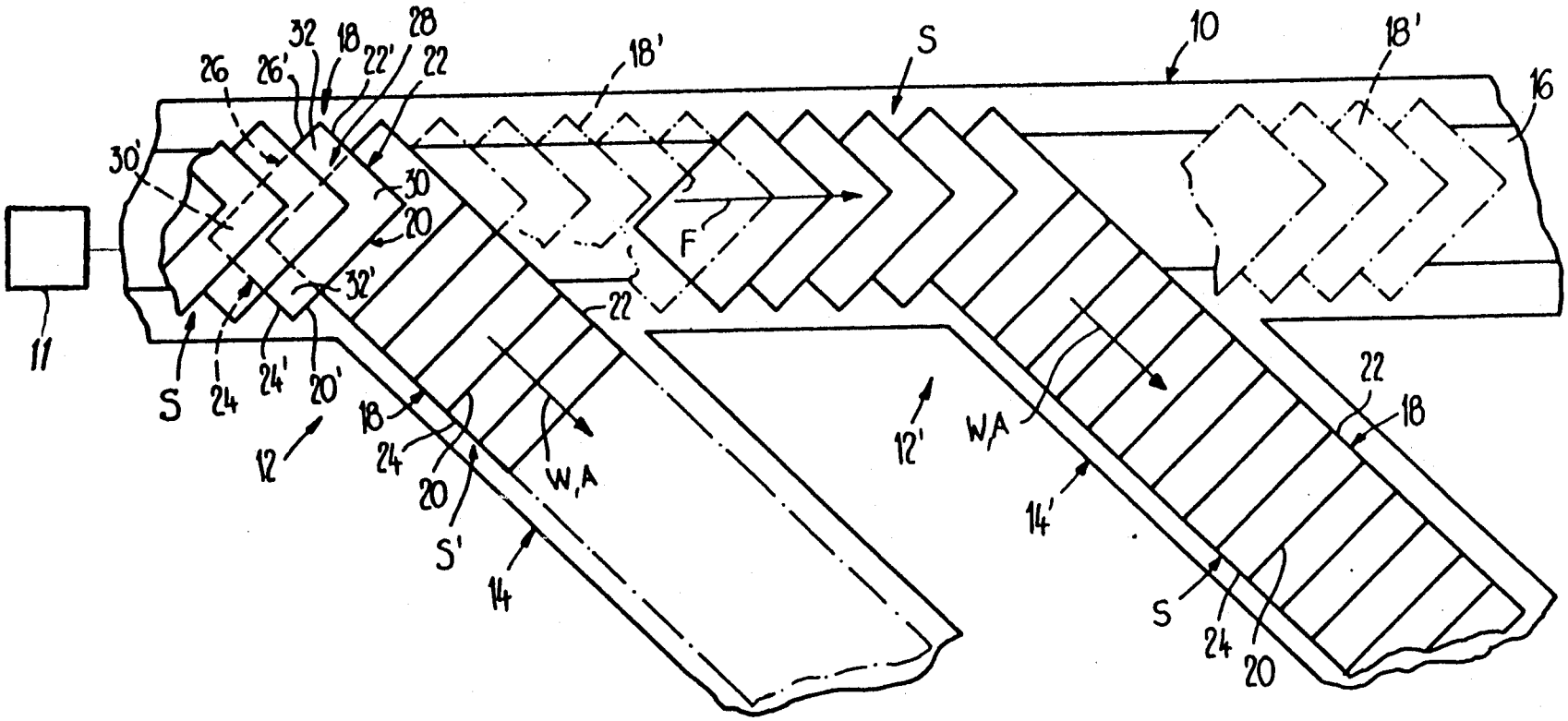
FIG. 1 shows, in a highly simplified manner, a transport device having two branch-off points arranged one behind the other.

The transport device shown in FIG. 1 is provided with a belt conveyor 10 which is led in a straight line past two branch-off points 12, 12'. Printing products 18 are supplied by a mechanism 11 for forming an imbricated formation with a leading edge of the printing products running at an angle with respect to the converging direction as described below. Removal conveyors 14, 14' whose conveying-away direction W runs at an angle to the conveying direction F of the belt conveyor 10, lead away from the belt conveyor 10 at the branch-off points 12, 12'. In the example shown, the angle between the conveying direction F and the conveying away direction W is 45°.

Printing products 18, for example multi-sheet folded newspapers, periodicals or the like, lie on the conveyor belt 16 of the belt conveyor 10 in an imbricated formation S in which, viewed in the conveying direction F, each printing product 18 lies on the preceding one. These printing products 18 are inclined with respect to the conveying direction F by 45°. The conveying-away direction W of the removal conveyor 14, 14' thus runs at right angles to the leading folded edge 20, viewed in the conveying direction F, facing the removal conveyors 14, 14' of the printing products 18. The leading side edge, viewed in the conveying direction F, adjacent to the folded edge 20 is designated by 22 and the trailing side edge by 24. The open edge, the so-called fore-edge, opposite the folded edge 20 and likewise trailing, viewed in the conveying direction F, is indicated by 26. It should be noted that an edge region 28, which is not covered or underlaid by any other printing products 18, of each printing product 18 is exposed in this imbricated formation S. Thus, viewed in the conveying direction F, sections 20' to 26' are exposed at the lateral end regions of the edges 20 to 26. A strip-shaped surface region 30 and 30', respectively, running along the folded edge 20 and side edge 22, and along the side edge 24 and edge 26, respectively, is in each case exposed on the upper and lower flat side of the printing products 18. The two surface regions 30, 30' overlap one another in the lateral corner regions 32, 32', viewed in conveying direction F. A part of the imbricated formation S, viewed in the conveying direction F, is in each case shown in solid lines situated upstream from the two branch-off points 12, 12'. Printing products 18', indicated in dot-dash lines in the region between the first branch-off point 12 and that part of the imbricated formation S situated upstream from the second branch-off point 12', are fed in the imbricated formation S to the first branch-off point 12 but are here deflected in a branch-off direction A, which corresponds to the conveying-away direction W, and are conveyed to the removal conveyor 14. Viewed in the conveying direction F, further printing products 18' are shown, following the second branch-off point 12' in an imbricated formation S, which printing products 18' are intended to indicate that those printing products 18 not deflected in branch-off direction A at the second branch-off point 12' and supplied to the removal conveyor 14' continue to be transported on the belt conveyor 10 without changing their position with respect to the conveying direction F.

The printing products 18 led in the branch-off direction A at the branch-off points 12, 12' and supplied to the removal conveyors 14, 14' are arranged in an imbricated formation S' in which, viewed in the direction of arrows W, A, each printing product lies on the preceding printing product 18, the folded edges 20 run at right angles to the direction of arrows W, A and the side edges 22, 24 are aligned with one another.

Figure 2:
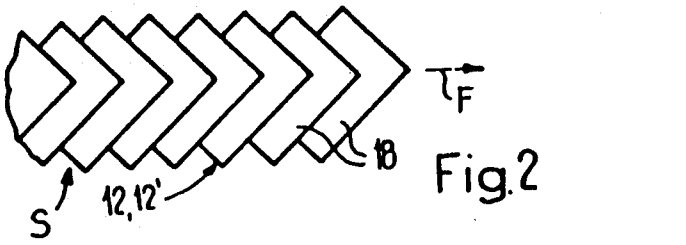
FIGS. 2 to 7 show, schematically, at different points in time, the branching-off of printing products from a fed imbricated formation.
Figure 3:
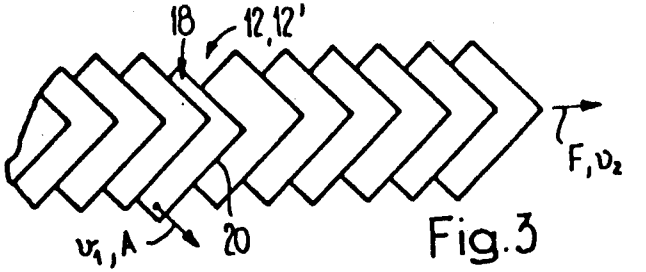
Figure 4:
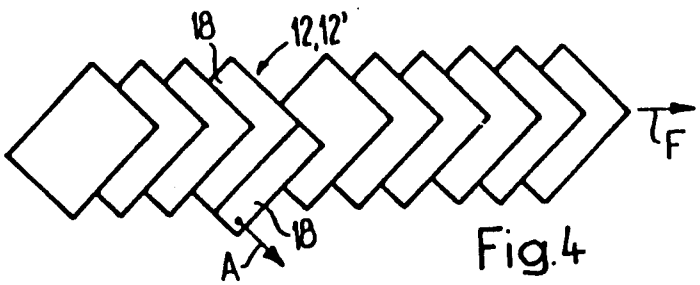
Figure 5:
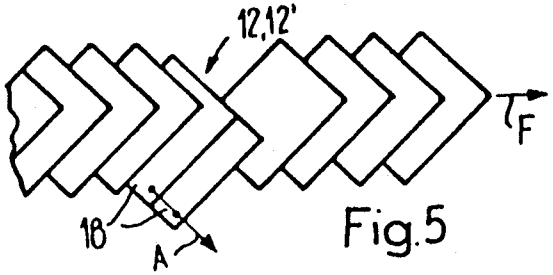
Figure 6:
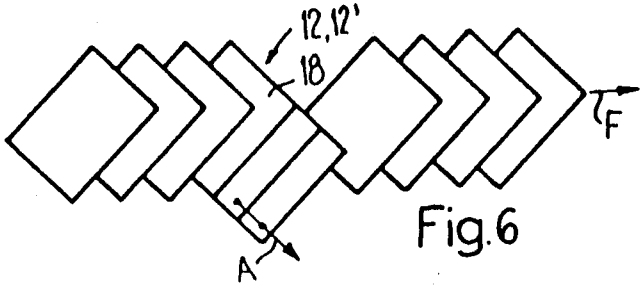
Figure 7:
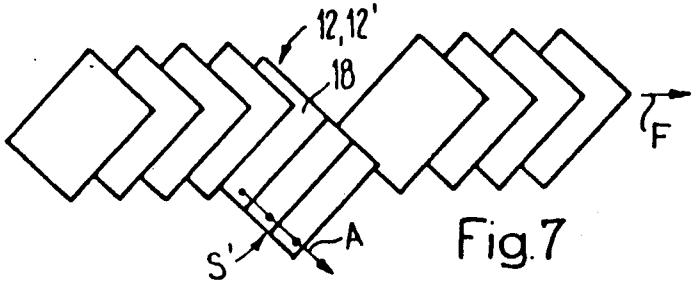

The branching-off at the branch-off points 12, 12' of the printing products 18 from the imbricated formation S transported by means of the belt conveyor 10 will now be explained in more detail with reference to FIGS. 2 to 7. In these FIGURES, the belt conveyor 10 and the removal conveyors 14, 14' are not shown. The imbricated formation S is conveyed to and partially past the branch-off points 12, 12' in the conveying direction F, the position of the printing products 18 with respect to the conveying direction F not changing (FIG. 2). Now if printing products 18 are to be detached from the imbricated formation S at the branch-off point 12, 12', then the first of these printing products 18 is deflected in the branch-off direction A which runs at an angle to the conveying direction F and at right angles to the folded edge 20. The component, relative to the conveyor direction F, of the conveyor speed $v_1$ of the removal conveyors 14, 14' is smaller than the conveyor speed $v_2$ of the belt conveyor 10 in conveying direction F (FIG. 3). Consequently, the succeeding printing product 18 catches up to the preceding printing product 18 deflected in the branch-off direction A, as shown in FIG. 4. As soon as this printing product 18 reaches the branch-off point 12, 12', it is likewise deflected in branch-off direction A where it comes to lie in the manner of roof tiles on the previously deflected printing product 18. In exactly the same way, the succeeding printing products 18 conveyed to the branch-off point 12, 12' are deflected in the branch-off direction A, as shown in FIGS. 6 and 7, with a further printing product 18. The printing products 18 deflected in the branch-off direction A are conveyed away by means of the removal conveyor 14 and 14', respectively, (cf. FIG. 1) in the conveying direction W which is identical to the branch-off direction A. As soon as the specified number of printing products 18, 18' have been branched-off at the branch-off point 12, 12', the succeeding fed printing products 18 are conveyed on in imbricated formation S in the conveying direction F. It should be noted that those printing products 18 not deflected at the branch-off point 12, 12' are conveyed on and past the branch-off point 12, 12' without changing their position with respect to the conveying direction F. In the above example, the conveyor speeds $v_1$ and $v_2$ of the removal conveyors 14, 14' and of the belt conveyor 10 are coordinated such that the distance, both in the imbricated formation S and in a direction at right angles to the folded edge 20, between the folded edges 20 of successive printing products 18, remains constant at all times.

Figures 8, 10, 11:
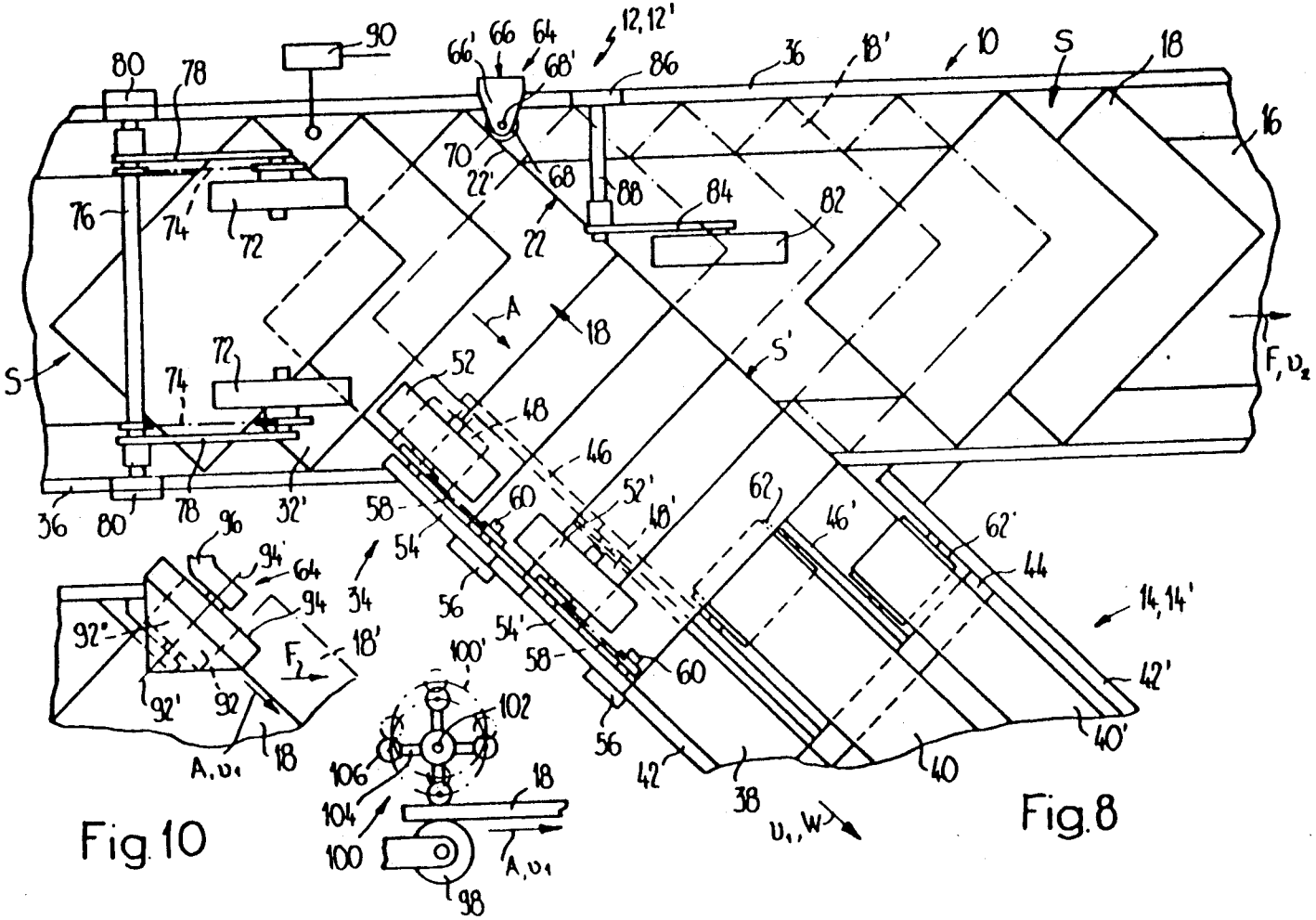
FIGS. 8 and 9 show, in plan and front view, respectively, and enlarged, a branch-off point of the transport device according to FIG. 1.
FIGS. 10 and 11 show two further embodiments of deflecting members.
Figure 9:
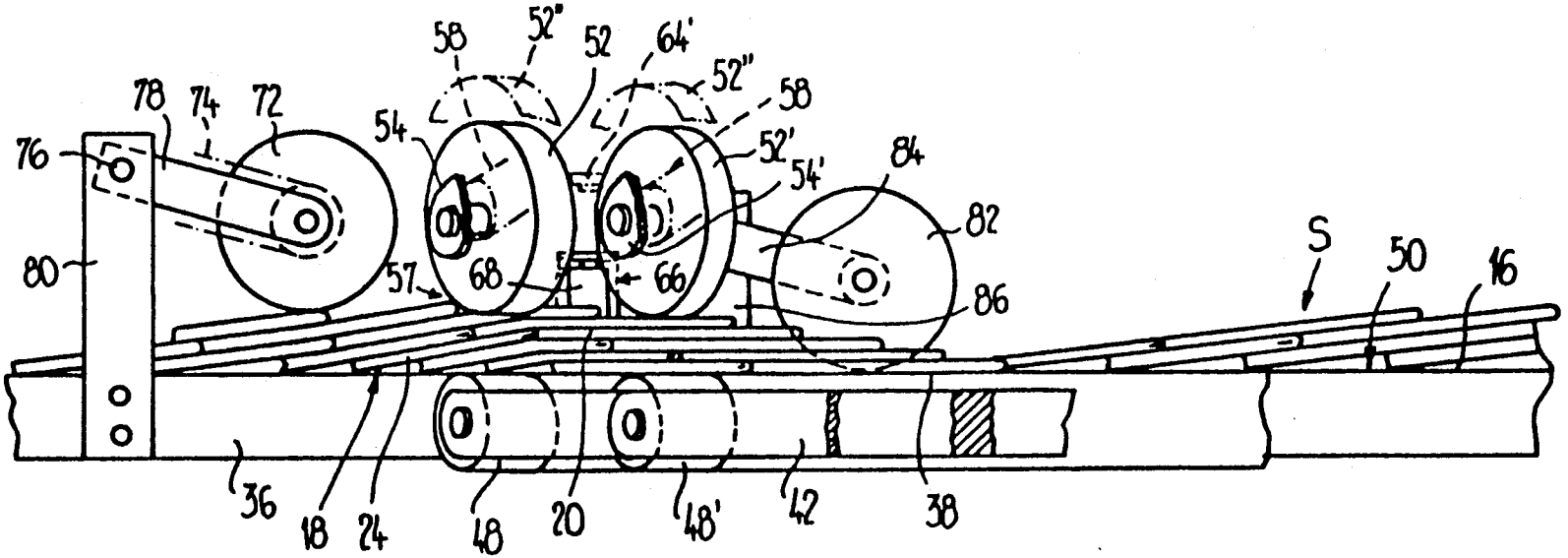

FIGS. 8 and 9 show, in plan and front view, respectively, a branching-off device 34 at the branch-off point 12 and 12', respectively, by means of which printing products 18 can be deflected from the fed imbricated formation S in the above-described way. The mutual position of the printing products 18 transported by means of the belt conveyor 10 in imbricated formation S, deflected at the branch-off point 12, 12' in the branch-off direction A, arranged in imbricated formation S' and fed to the removal conveyor 14, 14', and of the printing products 18' indicated by dot-dash lines corresponds to the mutual position of the relevant printing products 18, 18' according to FIG. 1.

The belt conveyor 10 has a frame 36, indicated schematically, on which the endless conveyor belt 16 is guided in a known manner via rollers (not shown). The conveyor belt 16 is driven in conveying direction F at the speed $v_2$. Viewed in the conveying direction F, the branch-off point 12, 12' follows the removal conveyors 14, 14' downstream, the conveying-away direction W of the removal conveyors 14, 14' running at an angle to the conveying direction F and their three conveyor belts 38, 40, 40' arranged next to one another and running parallel to one another being driven so as to circulate in conveying-away direction W at the speed $v_1$. The removal conveyor 14, 14' has lateral bearing plates 42, 42' which are connected to one another by means of a crosspiece 44 at a distance, viewed in the conveying-away direction W, from the frame 36 of the belt conveyor 10. Two arms 46, 46' are fastened to the crosspiece 44, project from the crosspiece 44 toward the belt conveyor 10 counter to the conveying-away direction W' and run between the conveyor belts 38, 40 and 40, 40', respectively. Two rolls 48 and 48', respectively, spaced apart from one another in conveying-away direction W, are mounted on the first crosspiece 46, viewed in the conveying direction F, and on the first bearing plate 42 so as to be freely rotatable. The roll 48, arranged so as to be freely rotatable in that end region of the bearing plate 42 and of the arm 46 facing the belt conveyor 10, is situated adjacent to the right-hand edge 16', viewed in the conveying direction F, of the conveyor belt 16 and in the region of the right-hand lateral corners 32' of the printing products 18. The other roll 48' follows the roll 48 downstream in the conveying-away direction W and the conveyor belt 38 is guided around this roll 48'. The conveying plane of the removal conveyor 14, 14' is coplanar with the conveying plane 50 defined by the belt conveyor 10 (see in particular FIG. 9). Conveying rolls 52, 52', driven so as to revolve in the conveying-away direction W, are provided above the rolls 48, 48' and are rotatably mounted in each case at the free end of weighted levers 54, 54'. The two weighted levers 54, 54' are mounted at the other end so as to swivel on the bearing profile 56 projecting upward from the bearing plate 42. The two conveying rolls 52, 52' are actively connected, via chain drives 58 indicated by dot-dash lines, in each case to a schematically indicated drive mechanism 60. The circumferential speed of the conveying rolls 52, 52' corresponds to the conveying-away speed $v_1$ of the removal conveyor 14 and 14' respectively. The conveying rolls 52, 52' situated in their lower working position, represented by solid lines, bear against the roll 48 and, via the active conveying side of the conveyor belt 38, against the roll 48' respectively, or on the printing products 18 lying on the conveyor belt 38. The roll 48, the conveyor belt 38 and the conveying rolls 52, 52' define a conveying nip 57 for these printing products 18. The conveying rolls 52, 52' can be brought by swiveling the weighted levers 54, 54' into an upper rest position 52'' represented in FIG. 9 by dot-dash lines in which the conveying rolls 52, 52' no longer bear against the roll 48, the conveyor belt 38 or the printing products 18 arranged thereon. The roll 48 and conveying rolls 52, 52' act as parts of the branching-off device 34, as is described further below.

The central conveyor belt 40 of the removal conveyor 14, 14' is guided about a roll 62 which is mounted on the arm 46 and in the free end region of the arm 46'. The arm 46' terminates outside the frame 36 of the belt conveyor 10. A further roll 62' is mounted on the arm 46' and on the bearing plate 42' so as to be freely rotatable and the conveyor belt 40' is guided around it. The active conveying sides of the conveyor belts 38, 40, 40' thus begin adjacent to the belt conveyor 10 outside its frame 36.

A deflecting element 64 is provided on the side opposite the conveying rolls 52, 52' with respect to the conveyor belt 16. This deflecting element 64 has an L-shaped support part 66 mounted on the frame 36 so as to be displaceable in the vertical direction and on the limb 66' of which, projecting toward the conveyor belt 16, a stop roll 68 is mounted so as to be freely rotatable. The axis of rotation 68' of this stop roll 68 runs vertically and the outer surface of the stop roll 68 forms a stop surface 70 for the exposed section 22' of the leading side edge 22, viewed in the conveying direction F, of the printing products 18 fed to the branch-off point 12, 12'. The deflecting element 64 may be raised, from the lower active position shown in FIGS. 8 and 9 in which the stop roll 68 pierces the conveying plane 50, into an upper rest position 64' represented in dot-dash lines in FIG. 9 in which the stop roll 68 lies above the printing products 18 lying on the conveyor belt 16. Viewed in the conveying direction F, the deflecting element 64 is positioned such that the section 22' of the side edge 22 comes to bear against it at the same time as the leading folded edge 20, viewed in the conveying direction F, as the same printing product 18 enters the conveying nip 57. This printing product 18 is deflected in the branch-off direction A by the conveying roller 52 and the stop roll 68, the stop roll 68 at the same time preventing the printing product 18 from rotating in a clockwise direction by virtue of being carried along by the belt conveyor 10.

Viewed in conveying direction F, the conveying roller 52 and the deflecting element 64 are preceded upstream by two weighted rolls 72 which are arranged above the conveyor belt 16 and are spaced apart from one another in a direction at right angles to the conveying direction F. The two weighted rolls 72 are actively connected, via chain drives 74 indicated in dot-dash lines, to a drive shaft 76 extending over the width of the belt conveyor 10 and on which single-arm levers 78 are mounted so as to be able to pivot freely, one weighted roll 72 being mounted in each case at their free end. The drive shaft 76 is mounted at both ends on a support 80 projecting upward from the frame 36, and is driven by means of a drive unit (not shown) such that the circumferential speed of the weighted rolls 72 corresponds to the conveying speed $v_2$ of the belt conveyor 10. Viewed in the conveying direction F, the weighted rolls 72 are positioned such that the printing product 18 deflected in the branch-off direction A is no longer influenced by them but that the succeeding printing product 18, viewed in the conveying direction F, is pressed against the conveyor belt 16.

Viewed in the conveying direction F, the support part 66 is followed downstream by a pressure roll 82 which is mounted on a further single-arm lever 84 so as to be freely rotatable. At the other end, the lever 84 is articulated, so as to be able to swivel freely about a horizontal axis, on a shaft 88 projecting from a further support 86 provided on the frame 36. The pressure roll 82 is positioned such that it does not act upon the printing products 18 deflected in the branch-off direction A but applies a load to the last printing product 18 of a section, led past the branch-off point 12, 12', of the imbricated formation S with its dead weight in the region of the leading corner before the succeeding printing product 18, viewed in the conveying direction F, is deflected in the branch-off direction A.

The support part 66 is, viewed in the conveying direction F, followed upstream by an optical counting device 90, a beam of light of which is interrupted by the left-hand lateral corner region 32, viewed in the conveying direction F, of each printing product 18. Furthermore, the first branch-off point 12 is preceded upstream by means for arranging the printing products 18 into an imbricated formation S. Such an imbricated formation S may be formed, for example, using a feed device such as described in Swiss Patent Application No. 03 340/89-8, or using a conveying device according to U.S. Pat. No. 3,239,676.

FIG. 10 shows another embodiment of the deflecting element 64. A deflecting roll 92, whose axis of rotation 92' runs parallel to the conveying plane 50 and at right angles to the conveying-away direction W, is driven in rotation, on the frame 36 of the belt conveyor 10, at a circumferential speed $v_1$. A cylindrical section of a deflecting part 94, which is mounted so as to be able to rotate freely about an axis of rotation 94' running parallel to the axis of rotation 92', rolls on the outer surface 92'' of this deflecting roll 92. Adjacent to the cylindrical section, the deflecting part 94 has a conical design and defines, together with the deflecting roll 92, a conveying nip, which tapers, viewed in the conveying direction F, and acts in the same direction as the branch-off direction A for the printing products 18 fed in conveying direction F to the deflecting element 64. The conical step surface is designated by 94''. A corresponding device for deflecting an imbricated formation by 90° is described in Swiss Patent Specification 617,408 and the corresponding U.S. Pat. No. 4,201,377. The deflecting part 94 is arranged at the free end of a bearing lever 96 whereby, when the bearing lever 96 is in its lower active position, the deflecting part 94 bears against the deflecting roll 92, and when it is in its upper rest position the deflecting part 94 is lifted off the deflecting roll 92 such that the fed printing products 18 can pass through between the deflecting roll 92 and the deflecting part 94. For the sake of completeness, it should be mentioned that a plurality of such deflecting parts 94 could, of course, be provided. When the bearing lever 96 is situated in the active position, the printing products 18 fed in the conveying direction F enter, with their exposed section 22' of the side edge 22, the conveying nip between the conically designed deflecting part 94 and the deflecting roll 92 and are deflected in the branch-off direction A.

FIG. 11 shows a further embodiment of a deflecting member which may be provided both instead of the deflecting element 64 and instead of the conveying rolls 52 of the device according to FIGS. 8 and 9. A star-wheel arrangement 100 is situated above a deflecting roller 98 driven in the branch-off direction A at a circumferential speed which corresponds to the conveying speed $v_1$ of the removal conveyor 14, 14'. This star-wheel arrangement 100 has a hub 102 from which spokes 104 project in a star shape, wheels 106 being mounted at the free ends of the spokes 104 so as to be able to rotate freely. The star-wheel arrangement 100 is driven in time with the arrival of the fed printing products 18 such that each printing product is taken up by one wheel 106. The star-wheel arrangement 100 has been shown in solid lines in its lower active position, in which the wheels 106 bear against the printing product 18 to be deflected in the branch-off direction A, and indicated in dot-dash lines in the upper rest position 100' in which the fed printing products 18 are conveyed in the conveying direction F between the deflecting roll 98 and the star-wheel arrangement 100 by means of the belt conveyor 10. With the star-wheel arrangement 100 active, the fed printing products 18 run into the active region of the star-wheel arrangement 100 with their exposed lateral corner regions 32, 32' of the surface regions 30, 30' and are deflected in the branch-off direction A.

The branching-off device 34 shown in FIGS. 8 and 9 works as follows. If the deflecting element 64 and the conveying rolls 52, 52' are situated in their upper rest positions 64' and 52'', respectively, then the printing products 18 fed in imbricated formation S are conveyed past the corresponding branch-off point 12, 12' unaffected. However, if printing products 18 are deflected out of the fed imbricated formation S in the branch-off direction A and led onto the removal conveyor 14, 14', then the deflecting element 64 and the conveying rollers 52, 52' are brought into their lower working positions. As a result, the next printing product 18 simultaneously runs up against the stop surface 70 with the section 22' of the side edge 22 and enters the conveying nip 57 between the roll 48 and the conveying roll 52 with its section 20' of the folded edge 20. This printing product 18 is deflected in the branch-off direction A, retaining its position with respect to the conveying direction F and conveyed onto the removal conveyor 14, 14' at the conveying speed $v_1$. The last printing product 18', viewed in the conveying direction F, that was not previously diverted in the branch-off direction A (indicated in dot-dash lines) is pressed against the preceding printing product 18' by the dead weight of the pressure roll 82, whereby the printing product 18' is prevented from being carried along in the branch-off direction A. These printing products 18 not deflected at the branch-off point 12 run in imbricated formation S to the branch-off point 12' where they either run past the branching-off device 34 in the conveying direction F or are deflected onto the removal conveyor 14'. The further printing products fed to the branch-off point 12 are deflected in the branch-off direction A, forming the imbricated formation S', and are transferred to the removal conveyor 14 in order to be conveyed away. The weighted rolls 72 thus protect the printing products 18, which have not yet run up onto the stop surface 70 and been fed to the conveying roll 32, from being carried along by friction in the branch-off direction A.

Now if the succeeding fed printing products 18 are no longer to be deflected in the branch-off direction A, but are to be conveyed in conveying direction F, then the deflecting element 64 and the conveying roll 52 are raised into their rest positions 64' and 52'', respectively. The next printing product 18 fed to the branch-off point 12 is now on longer deviated but conveyed on in the conveying direction F. The conveying roller 52' thus prevents the printing products 18 previously deflected in branch-off direction A from being carried along in conveying direction F.

The removal conveyors may be arranged on alternate sides with respect to the belt conveyor. The deflecting members of the branching-off device must accordingly be provided in each case as described above or on the other side of the conveyor belt.

It is, of course, also conceivable for the conveying-away direction to run at an angle to the branch-off direction A. The printing products fed to the removal conveyor in branch-off direction are then arranged on the removal conveyor, and conveyed away by it, without any change in their position with respect to the conveying direction, again in an imbricated formation in which the edges run at an angle to the conveying-away direction. If the printing products deflected in the branch-off direction are consequently fed to a removal conveyor, whose conveying-way direction W runs parallel to the conveying direction F, then the printing products are conveyed away in the same imbricated formation in which they were fed to the branch-off point. It is, of course, also conceivable for further branch-off points to follow the branch-off points downstream, viewed in the conveying-away direction. However, the printing products 18 fed to the removal conveyors 14, 14' are usually supplied to a processing station. The printing products led past the second branch-off point 12' may be fed to a downstream branch-off point or to a processing station. It is possible, using the device described, for both whole sections and individual printing products to be detached from the fed imbricated formation.

What is claimed is:

1. A process for transporting printing products, comprising the steps of:

feeding the printing products in a feed direction with edges thereof inclined at an angle with respect to the feed direction and overlapping one another;

conveying, in the feed direction, the printing products in an imbricated formation to a branch-off point defining a branch-off direction running at an angle to the feed direction, a number of the printing products while essentially retaining their position with respect to the feed direction being conveyed past the branch-off point;

acting upon a remainder of the fed printing products led at the angle at the branch-off point at a leading edge region exposed by the incline;

deflecting said remainder of the fed printing products by a deflecting element brought into and out of action with respect to a section of the leading edge region exposed by the incline of fed printing products such that the section of the edge regions strike the deflecting element; and leading the remainder of the printing products at the branch-off point in the branch-off direction running at an angle to the feed direction.

2. The process according to claim 1, wherein the printing products led at an angle at the branch-off point are led in an essentially unchanged position with respect to the feed direction.

3. The process according to claim 1, wherein the printing products led at an angle at the branch-off point are led in a branch-off direction which approximately corresponds to the incline of the fed printing products.

4. The process according to claim 1, wherein the printing products led at an angle at the branch-off point are guided onto a removal conveyor whose conveying-away direction runs at an angle with respect to said feed direction.

5. The process according to claim 4, further comprising the step of guiding fed printing products sectionwise onto a removal conveyor with a conveying-away direction essentially corresponding to the incline of the fed printing products and conveying in an imbricated formation in which leading edges viewed in said conveying-away direction of the printing products run approximately at right angles to the conveying-away direction, side edges of the printing products being aligned with one another.

6. The process according to claim 5, wherein the printing products are fed to the branch-off point with leading folded edges, viewed in the feed direction, and the printing products guided onto the removal conveyor are conveyed with the folded edges running essentially at right angles to the conveying-away direction.

7. The process according to claim 1, wherein the printing products led at an angle at the branch-off point are guided onto a removal conveyor whose conveying-away direction runs approximately parallel to said feed direction, and the printing products guided onto the removal conveyor are conveyed away with their position essentially unchanged with respect to the feed direction.

8. The process according to claim 1, further comprising the step of feeding the printing products which are led past the branch-off point to a further branch-off point and leading said printing products at least partially past this branch-off point, the printing products essentially retaining the position of the printing products with respect to the feed direction.

9. An apparatus for transporting printing products arriving in an imbricated formation, and for feeding the arriving printing products to, and at least partially past, a branch-off point, their position being essentially retained with respect to the conveying direction of the conveying device, comprising:

a conveying device leading past said branch-off point;

a branching-off device provided at the branch-off point for leading a number of the fed printing products in a branch-off direction running at an angle to the conveying direction, wherein the branch-off point, viewed in the conveying direction, is followed downstream by a removal conveyor for guiding away the printing products led in the branch-off direction, the conveying device transporting the printing products with a leading edge thereof running at an angle defining an incline with respect to the conveying direction, and said printing products overlapping one another, wherein said branching-off device comprises a deflecting member which can be brought into and out of action on a region exposed by the incline of the fed printing products, and wherein the deflecting member comprises, on the side opposite the removal conveyor with respect to the conveying device, a deflecting element and a branching-off element, respectively, and, on the side facing the removal conveyor, a branching-off element for leading the printing product in the branch-off direction by acting on a region of the same printing product.

10. An apparatus for transporting printing products arriving in an imbricated formation, and for feeding the arriving printing products to, and at least partially past, a branch-off point, their position being essentially retained with respect to the conveying direction of the conveying device, comprising:

a conveying device leading past said branch-off point;

a branching-off device provided at the branch-off point for leading a number of the fed printing products in a branch-off direction running at an angle to the conveying direction, the conveying device transporting the printing products with a leading edge thereof running at an angle defining an incline with respect to the conveying direction, and said printing products overlapping one another, wherein said branching-off device comprises a movable deflecting element which can be brought into and out of action on the leading edge region exposed by the incline of the fed printing products such that a section of the leading edge region strikes the deflecting element for deflecting the number of fed printing products.

11. The apparatus according to claim 10, further comprising an optical counting device, for switching the branching-off device on and off, provided at the branching-off device.

12. The apparatus according to claim 11, wherein said optical counting device is upstream said branching-off device.

13. The apparatus according to claim 11, wherein said optical counting device counts printing products by detecting lateral end regions of successive printing products.

14. The apparatus according to claim 10, wherein the branch-off point is preceded upstream by means for forming an imbricated formation with said leading edge of the printing products running at an angle with respect to the conveying direction.

15. The apparatus according to claim 10, wherein the deflecting member comprises a branching-off element which may be brought to act at least on a surface region, present on a flat side of said printing products, of the exposed region, in order to lead printing products in the branch-off direction.

16. The apparatus according to claim 15, wherein the branching-off element comprises a branching-off part arranged above a surface provided essentially in a conveying plane defined by the conveying device, and forming, together with said surface, a conveying nip active in the same direction as the branch-off direction.

17. The apparatus according to claim 10, wherein the branch-off point, viewed in the conveying direction, is followed downstream by a removal conveyor for guiding away the printing products led in the branch-off direction.

18. The apparatus according to claim 17, wherein the conveying-away direction of the removal conveyor runs essentially in the branch-off direction..

19. The apparatus according to claim 17, wherein the deflecting member comprises, on the side opposite the removal conveyor with respect to the conveying device, a deflecting element and a branching-off element, respectively, and, on the side facing the removal conveyor, a branching-off element for leading the printing product in the branch-off direction by acting on an edge region of the same printing product.

20. The apparatus according to claim 10, wherein the deflecting element comprises a stop surface running transversely to a conveying plane of the conveying device and revolving essentially in the branch-off direction.

* * * * *